US010940378B1

(12) United States Patent
Offerman

(10) Patent No.: US 10,940,378 B1
(45) Date of Patent: Mar. 9, 2021

(54) GOLF PUTTING DEVICE

(71) Applicant: Bradley James Offerman, Oswego, IL (US)

(72) Inventor: Bradley James Offerman, Oswego, IL (US)

( * ) Notice: Subject to any disclaimer, the term of this patent is extended or adjusted under 35 U.S.C. 154(b) by 0 days.

(21) Appl. No.: 16/809,161

(22) Filed: Mar. 4, 2020

Related U.S. Application Data

(63) Continuation-in-part of application No. 16/798,305, filed on Feb. 22, 2020.

(60) Provisional application No. 62/960,765, filed on Jan. 14, 2020.

(51) Int. Cl.

| | |
|---|---|
| ***A63B 67/02*** | (2006.01) |
| ***A63B 69/36*** | (2006.01) |
| ***A63B 71/06*** | (2006.01) |
| ***A63B 63/08*** | (2006.01) |
| ***A63B 57/40*** | (2015.01) |
| *A63B 63/00* | (2006.01) |

(52) U.S. Cl.
CPC ..... *A63B 67/02* (2013.01); *A63B 57/40* (2015.10); *A63B 63/08* (2013.01); *A63B 69/3661* (2013.01); *A63B 69/3676* (2013.01); *A63B 71/0622* (2013.01); *A63B 2063/001* (2013.01); *A63B 2067/025* (2013.01); *A63B 2071/0633* (2013.01)

(58) Field of Classification Search
CPC ..... A63B 67/02
USPC ..... 473/173–195
See application file for complete search history.

(56) References Cited

U.S. PATENT DOCUMENTS 1,503,415 A * 7/1924 Fohmann ..... A63F 7/305 273/123 R
1,637,407 A * 8/1927 Brumder ..... A63B 57/40 473/184
1,689,475 A * 10/1928 Brumder ..... A63B 57/40 473/184

(Continued)

FOREIGN PATENT DOCUMENTS

EP 0425751 A1 * 8/1991
GB 2409171 6/2005

(Continued)

OTHER PUBLICATIONS https://www.amazon.co.uk/PUTT-BOUT-Grassroots-Putting-9-feet/dp/B001B6CH0S/ref=sr_1_2?dchild=1&keywords=Putt-A-Bout+Grassroots+Pa%E2%80%A6, PUTT-A-BOUT Grassroots Par Three Putting Green (9-feet×3-feet), by PUTT-A-BOUT.

*Primary Examiner* — Eugene L Kim
*Assistant Examiner* — Matthew B Stanczak
(74) *Attorney, Agent, or Firm* — The Law Offices of Konrad Sherinian, LLC

(57) ABSTRACT

A new golf putting device incorporates a concave ramp turf surface having a set of golf putting receptacles and a corresponding set of golf putting receptacle plugs, and a set of distance indicia corresponding to the set of golf putting receptacles. Each golf putting receptacle plug includes a body portion and a turf layer. The receptacle's turf layer forms a part of the ramp turf surface and smoothly transitions into the ramp turf surface. The golf putting device also includes a frame structure and a ramp layer attached to the frame structure. The ramp turf is attached to the ramp layer. The golf putting device also includes a set of rails on the two sides of the ramp turf surface. The golf putting device further includes a set of target zone indicia on the ramp turf surface.

13 Claims, 6 Drawing Sheets

(56) References Cited

U.S. PATENT DOCUMENTS

D77,020 S * 11/1928 Meilicke ..... D21/790
1,773,813 A * 8/1930 Gourlay ..... A63B 67/02 473/185
2,232,569 A * 2/1941 Bernays ..... A63B 63/08 473/191
2,912,248 A * 11/1959 Di Buono ..... A63F 7/0628 473/163
D201,689 S * 7/1965 Lindner ..... D21/790
3,476,076 A * 11/1969 McDougall, Jr. ..... A63B 67/02 116/223
3,727,918 A * 4/1973 Zawacki ..... A63B 67/02 473/159
3,762,718 A * 10/1973 Culley ..... A63B 57/357 473/160
3,772,841 A * 11/1973 Barak ..... A63B 57/40 52/741.1
3,817,535 A * 6/1974 Doughty ..... A63F 7/305 473/185
3,844,558 A * 10/1974 Gigliotti ..... A63F 7/0628 273/317.2
3,870,301 A * 3/1975 Brisendine ..... A63B 57/357 473/179
4,203,604 A * 5/1980 La Grange ..... A63B 69/3661 273/DIG. 13
D261,791 S * 11/1981 Todd ..... 473/195
4,691,923 A * 9/1987 Schwartz ..... A63B 63/08 273/127 B
4,828,267 A * 5/1989 Goodrich ..... A63B 47/00 473/160
4,949,970 A * 8/1990 Culley ..... A63B 67/02 473/160
5,078,394 A * 1/1992 Kretz ..... A63B 69/3676 473/179
5,082,280 A * 1/1992 Wang ..... A63B 67/02 428/100
5,129,653 A * 7/1992 Morris ..... A63B 67/02 473/184
5,131,658 A * 7/1992 Grenon ..... A63B 63/00 473/185
5,165,690 A * 11/1992 Kelley, Jr. ..... A63B 63/007 472/88
5,242,169 A * 9/1993 Laabs ..... A63B 67/02 473/184
5,306,009 A * 4/1994 Bolanos ..... A63B 63/00 473/157
D348,501 S * 7/1994 Wong ..... D21/790
5,573,247 A * 11/1996 Ridge ..... A63B 63/08 273/271
5,586,941 A * 12/1996 Klearman ..... A63B 69/3676 473/160
D382,601 S * 8/1997 Antill ..... D21/303
6,569,027 B2 5/2003 Florian
6,607,448 B2 8/2003 Moore
6,623,373 B2 * 9/2003 Carlton ..... A63B 69/3652 273/DIG. 13
6,709,342 B1 * 3/2004 Brezic ..... A63B 57/357 473/179
6,716,113 B1 * 4/2004 Manning ..... A63B 69/3676 473/261
6,905,418 B2 * 6/2005 Rhee ..... A63B 63/00 473/172
7,294,062 B2 * 11/2007 Ting ..... A63B 67/02 473/160
7,597,558 B2 10/2009 Mazloompour
8,287,395 B2 10/2012 Green et al.
8,702,528 B1 * 4/2014 Montgomery ..... A63B 67/066 473/157
D740,383 S * 10/2015 Shadle ..... D21/791
D763,388 S * 8/2016 Sanders ..... D21/791
D856,430 S * 8/2019 Cangi ..... D21/303
2003/0109318 A1 * 6/2003 Oyauchi ..... A63B 69/3661 473/192
2003/0207716 A1 * 11/2003 Bradstock ..... A63B 69/3623 473/194
2004/0005933 A1 * 1/2004 Maruszczak ..... A63B 24/0021 473/192
2007/0197306 A1 * 8/2007 Ting ..... A63B 67/02 473/174
2008/0102969 A1 * 5/2008 Garske ..... A63B 57/357 473/173
2010/0331094 A1 * 12/2010 Graves ..... A63B 57/357 473/179
2011/0124427 A1 * 5/2011 Green ..... A63B 69/3661 473/159
2013/0035172 A1 * 2/2013 Woodhouse ..... A63B 57/357 473/179
2014/0364244 A1 * 12/2014 Ross ..... A63B 57/20 473/173
2015/0087433 A1 * 3/2015 Roberts ..... A63B 69/3661 473/195
2015/0209637 A1 * 7/2015 Curtis ..... A63B 67/02 473/157
2016/0030819 A1 * 2/2016 Ahn ..... A63B 69/3623 473/192
2016/0074736 A1 * 3/2016 Bae ..... A63B 67/02 473/190

FOREIGN PATENT DOCUMENTS

JP 2014-124352 A * 7/2014
KR 20000018926 10/2000
KR 20130007742 7/2011
KR 101612731 B1 4/2016
WO 2004-082775 A1 * 9/2004

* cited by examiner 900
120
118
116
114
112
35
30
25
20
15
0
138
136
134
132
102
102
122
912
904
906
902
912
142
106
104

152
138
136
134
132
106
702
104
1002
1004
1006
1008
1010
102

GOLF PUTTING DEVICE

CROSS REFERENCE TO RELATED APPLICATIONS

This application is a continuation-in-part of co-pending U.S. patent application Ser. No. 16/798,305, entitled "GOLF PUTTING DEVICE," filed Feb. 22, 2020, which is hereby incorporated by reference in its entirety. This application also claims the benefit and priority of U.S. Provisional Patent Application No. 62/960,765, entitled "GOLF PUTTING DEVICE", filed Jan. 14, 2020, which is hereby incorporated by reference in its entirety.

FIELD OF THE DISCLOSURE

The present invention generally relates to golfing equipment, and more particularly relates to a device for practicing golf putting. More particularly still, the present disclosure relates to a golf putting device incorporating a ramp surface.

DESCRIPTION OF BACKGROUND

There are millions of golf players in the world. They like playing golf and desire to improve their playing skills. One of such skills is accurate putting. Golfers practice putting on putting greens and actual greens on golf courses (collectively referred to herein putting greens). Putting is a golf stroke with a putter club by a golfer. The purpose of the stroke is to hit a golf ball and send it into a golf hole. A golf hole is usually 4.25 inches in diameter.

However, access to a putting green is not always available. For instance, putting greens may be covered by snow in winter. As another example, practicing putting on a putting green is not feasible on rainy days. As yet another example, very hot and cold temperatures may prevent putting on actual putting greens for health concerns. Accordingly, there is a need for a portable putting device allowing a golfer to practice putting anytime the golfer desires to do so. The portable putting device allows the golfer to practice putting indoor or outdoor. Regardless of the weather, the golfer can practice putting using the portable putting device indoor. For example, the golfer places the putting device in her/his basement, and can practice putting all year long.

There are many situations where space is limited for golfers. For instance, in a basement of a residential house, putting over a long distance (such as 30 feet or 35 feet) is not possible or hard to achieve. Accordingly, there is a need for a new type of putting devices that allows golfers to practice golf putting for a distance that is longer than the horizontal distance a golf ball actually travels.

SUMMARY OF THE DISCLOSURE

Generally speaking, pursuant to the various embodiments, the present disclosure provides a golf putting device. The golf putting device includes a frame structure, a ramp layer attached to the frame structure, a ramp turf layer attached to the ramp layer, a set of sliding distance bars removably attached to the frame, a set of distance indicia on the set of sliding distance bars, and a golf ball retriever mounted to the frame structure. Each sliding distance bar includes a sliding distance bar frame and a sliding distance bar turf layer attached to the sliding distance bar frame. The golf putting device also includes a golf putting hole, a distance indicia corresponding to the golf putting hole, and a golf putting hole plug adapted to be inserted into the golf putting hole. The golf putting device further includes a putting hole zone indicia.

Further in accordance with the present teachings is a new golf putting device. The new golf putting device includes a frame, a ramp layer mounted to the frame, a golf turf layer attached to the ramp layer and forming a ramp surface. The ramp surface is concave in shape. The golf turf layer is made of synthetic golf turf. The new golf putting device also includes a first set of distance indicia on the golf turf layer. The first set of distance indicia indicate different distances. The new golf putting device further includes a set of golf putting holes running through the golf turf layer and the ramp layer. The set of golf putting holes correspond to the first set of distance indicia. In addition, the new golf putting device includes a set of golf putting hole plugs adapted to be received by and removed from the set of golf putting holes respectively. Each of the set of golf putting hole plugs including a body portion and a plug turf layer attached to the body portion. The plug turf layer is made of synthetic golf turf and adapted to form a part of the ramp surface. Moreover, the new golf putting device includes a set of rails on sides of the ramp surface, and a putting hole zone indicia on the ramp surface. The set of golf putting holes are disposed within the putting hole zone.

Further in accordance with the present teachings is a new golf putting device. The new golf putting device includes a frame, a ramp layer mounted to the frame, and a golf turf layer attached to the ramp layer and forming a ramp surface. The ramp surface is concave in shape. The golf turf layer made of synthetic golf turf. The new golf putting device also includes a first set of distance indicia on the golf turf layer. The first set of distance indicia indicates different distances. The new golf putting device further includes a set of golf putting receptacles in rectangular shapes corresponding to the first set of distance indicia and running through the golf turf layer. Each golf putting receptacle within the set of golf putting receptacles has a width of approximately two inches and a length of approximately four and a quarter inches. In addition, the new golf putting device includes a set of golf putting receptacle plugs adapted to be received by and removed from the set of golf putting receptacles respectively. Each of the set of golf putting receptacle plugs includes a body portion and a receptacle turf layer attached to the body portion. The receptacle turf layer is made of synthetic golf turf and adapted to form a part of the ramp surface. Moreover, the new golf putting device includes a set of rails on sides of the ramp surface, a set of target zone indicia corresponding to the set of golf putting receptacles respectively, and a golf ball retriever communicating with the set of golf putting receptacles. In a further implementation, the new golf putting device includes a flat front end portion. Moreover, the new golf putting device includes a flat extension adapted to smoothly mate with a front end of the golf putting device.

The golf putting device also includes a second set of distance indicia on the ramp surface. The second set of distance indicia correspond to the set of golf putting holes and are positioned opposite to the first set of distance indicia. In addition, the golf putting device of includes a flat front end portion. In a further implementation, it includes a flat extension adapted to smoothly mate with a front end of the golf putting device. Each hole within the set of golf putting holes has a diameter of three and half inches. Furthermore, the golf putting device includes a golf ball retriever communicating with the set of golf putting holes.

BRIEF DESCRIPTION OF THE DRAWINGS

Although the characteristic features of this disclosure will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

A person of ordinary skills in the art will appreciate that elements of the figures above are illustrated for simplicity and clarity, and are not necessarily drawn to scale. The dimensions of some elements in the figures may have been exaggerated relative to other elements to help understanding of the present teachings. Furthermore, a particular order in which certain elements, parts, components, modules, steps, actions, events and/or processes are described or illustrated may not be actually required. A person of ordinary skill in the art will appreciate that, for the purpose of simplicity and clarity of illustration, some commonly known and well-understood elements that are useful and/or necessary in a commercially feasible embodiment may not be depicted in order to provide a clear view of various embodiments in accordance with the present teachings.

DETAILED DESCRIPTION

Figure 1:
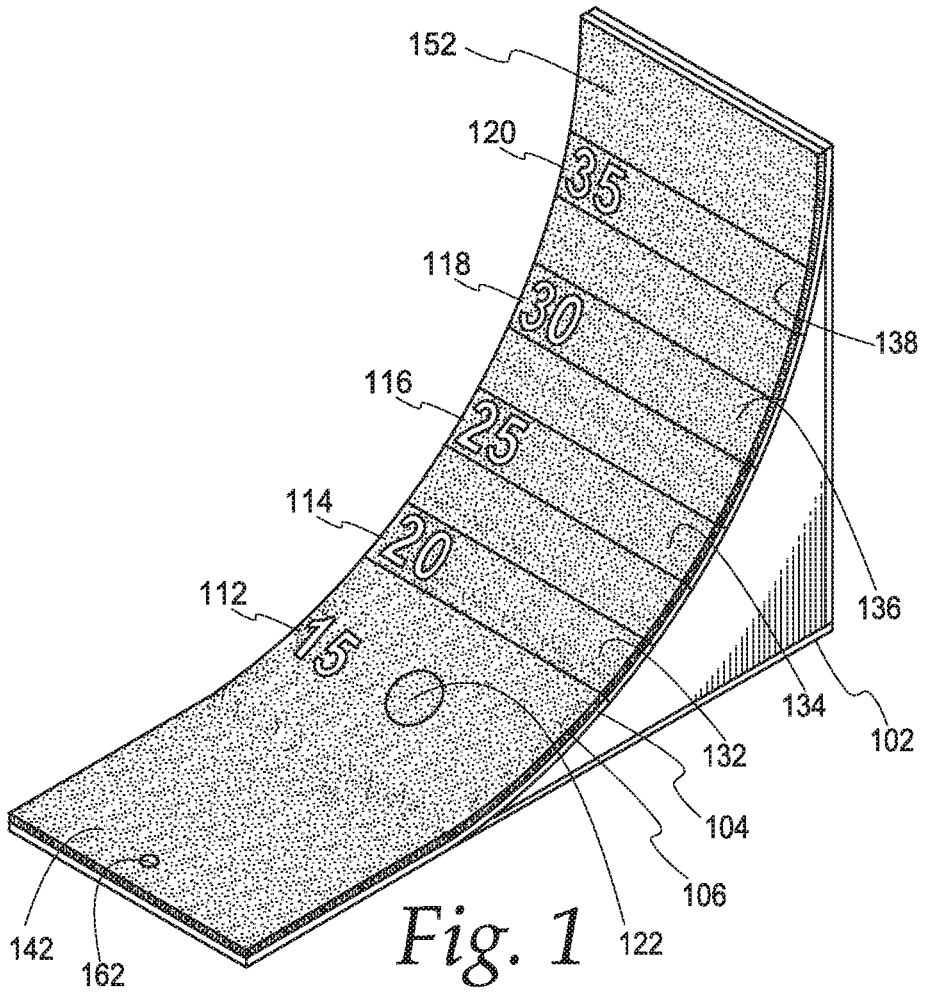
FIG. 1 is a perspective view of a new golf putting device with a ramp surface in accordance with the teachings of this disclosure.

Turning to the Figures and to FIG. 1 in particular, a perspective view of a new golf putting device is shown and generally indicated at 100. The golf putting device 100 includes a frame 102, a ramp layer 104 mounted to the frame 102, a golf turf layer 106 attached to the ramp layer 104, a set (meaning one or more) of distance indicia 112, 114, 116, 118 and 120 on the golf turf layer 106, a golf putting hole plug 122 disposed in a golf putting hole, and a set of sliding distance bars 132, 134, 136 and 138. The golf turf layer 106 forms a ramp surface 152. The ramp surface 152 is concave in shape. In one implementation, the golf turf layer 106 is made of synthetic golf turf.

Figure 2:
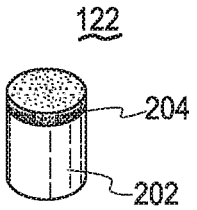
FIG. 2 is a perspective view of a golf putting hole plug in accordance with this disclosure.

The golf putting hole plug 122 is further illustrated by reference to Figure Referring to FIG. 2, a perspective view of the golf putting hole plug 122 is shown. The golf putting hole plug 122 includes a cylindrical body portion 202 and a plug turf layer 204 attached to the cylindrical body portion 202. The diameter of the cylindrical body 202 and the golf turf layer 204 is approximately 3.5 inches.

Turning back to FIG. 1, the new golf putting device 100 includes one or more sliding distance bars, such as the sliding distance bars 132-138. The set of the sliding distance bars 132-138 include a corresponding set of distance indicia 114-120. In one implementation, the set of distance indicia 112-120 are printed on the golf turf layer 106. The prints can be in, for example, white color. In a different implementation, the set of distance indicia 112-120 are labels attached to the golf turf layer 106. In the illustrative embodiment, the set of distance indicia 112-120 indicate fifteen feet, twenty feet, twenty-five feet, thirty feet and thirty-five feet respectively. The distances are relative to a reference point 162. Furthermore, the distance indicia 112-120 indicate different distances and distributed on the ramp surface 152 in an increasing order.

Figure 3:
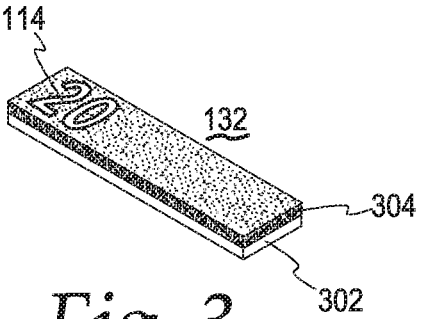
FIG. 3 is a perspective view of a sliding distance bar in accordance with this disclosure.

The sliding distance bars 132-138 are further illustrated by reference to FIG. 3. Referring now to FIG. 3, a perspective view of, for example, the sliding distance bar 132 is shown. The sliding distance bar 132 includes a sliding distance bar frame 304 and a sliding distance bar turf layer 302 attached to the frame 304. The sliding distance bar turf layer 304 has a concave surface to conform with the ramp surface 152. It should be noted that the surface 304 can be constructed to have a flat surface, which is less desirable. The width of each of the sliding distance bars 132-138 is 2 inches in one implementation. The width of each of the sliding distance bars 132-138 is its shorter side. The length of each of the sliding distance bars 132-138 is same as the width of the ramp surface 152. In one implementation, the length of each of the sliding distance bars 132-138 is approximately 12 inches.

Figure 4:
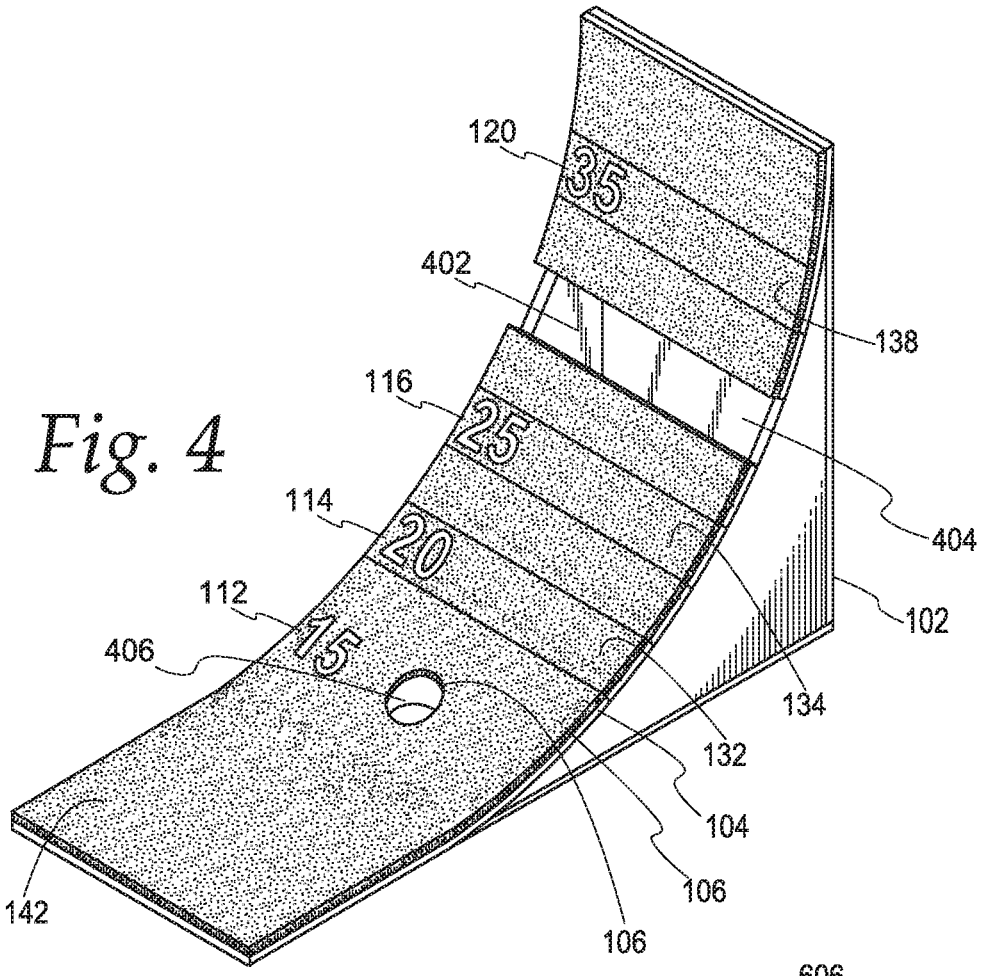
FIG. 4 is a perspective view of a new golf putting device with a ramp surface in accordance with this disclosure.

Each of the sliding distance bars 132-138 can be pulled forward and away from the putting device 100. Each of them can also be adapted to be pulled sideways and away from the putting device 100. The new golf putting device 100 with the sliding distance bar 136 slid away is shown in FIG. 4. Referring now to FIG. 4, with the sliding distance bar 136 removed, a golf ball retriever 402 is exposed via the opening 404 created by the removal of the sliding distance bar 136. The opening 404 has the same width as the sliding distance bars 132-138. With the same width, when the sliding distance bars 132-138 are installed on the putting device 100, they become part of the ramp surface 152 and cause a smooth transition between the surface of the sliding distance bars 132-138 and the rest of the ramp surface 152. The smooth transition allows smooth movement of golf balls on the ramp surface 152. A golf putting hole for receiving the golf putting hole plug 122 is indicated at 406. When the golf putting hole plug 122 is inserted into the hole 406, the plug turf layer 204 conforms to the ramp surface 152. The transition between the turf 204 and the ramp surface 152 is smooth as well. The diameter of the hole 406 is 4.25 inches.

Figure 5:
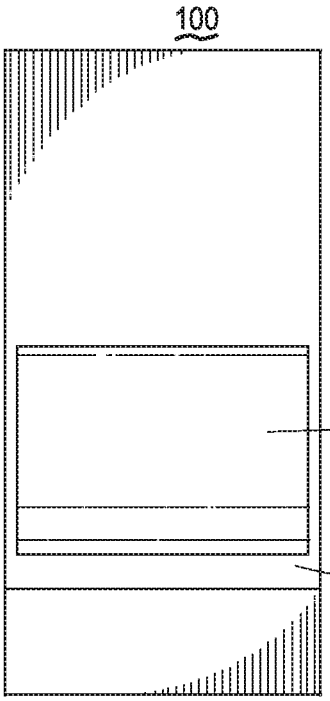
FIG. 5 is a rear view of a new golf putting device in accordance with this disclosure.
Figure 6:
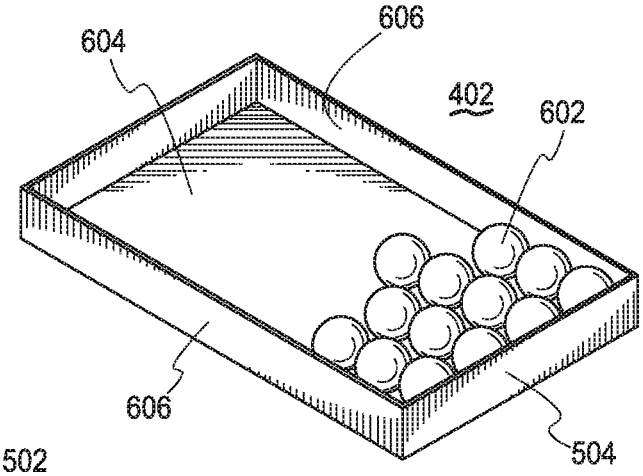
FIG. 6 is a perspective view of a golf ball retriever in accordance with this disclosure.

Referring to FIG. 5, a rear view of the new golf putting device 100 is shown. The rear side of the golf putting device 100 exposes a rear side 504 of the golf ball retriever 402 and an opening 502 for a golfer to retrieve golf balls from the golf ball retriever 402 by hands. A perspective view of the golf ball retriever 402 is shown in FIG. 6. The golf ball retriever 402 is mounted to or is an integral part of the golf putting device 100. The golf ball retriever 402 incorporates a rear side 504, a bottom side 604 and two side walls 606. The bottom side 604 is not flat, and tilts downward toward the rear end of the golf putting device 100. The uneven bottom surface 604 causes golf balls 602 to roll toward the rear wall 504 when they fall through the openings 404 and into the retriever 402. The openings 404 are covered by the sliding distance bars 132-138.

Figure 7:
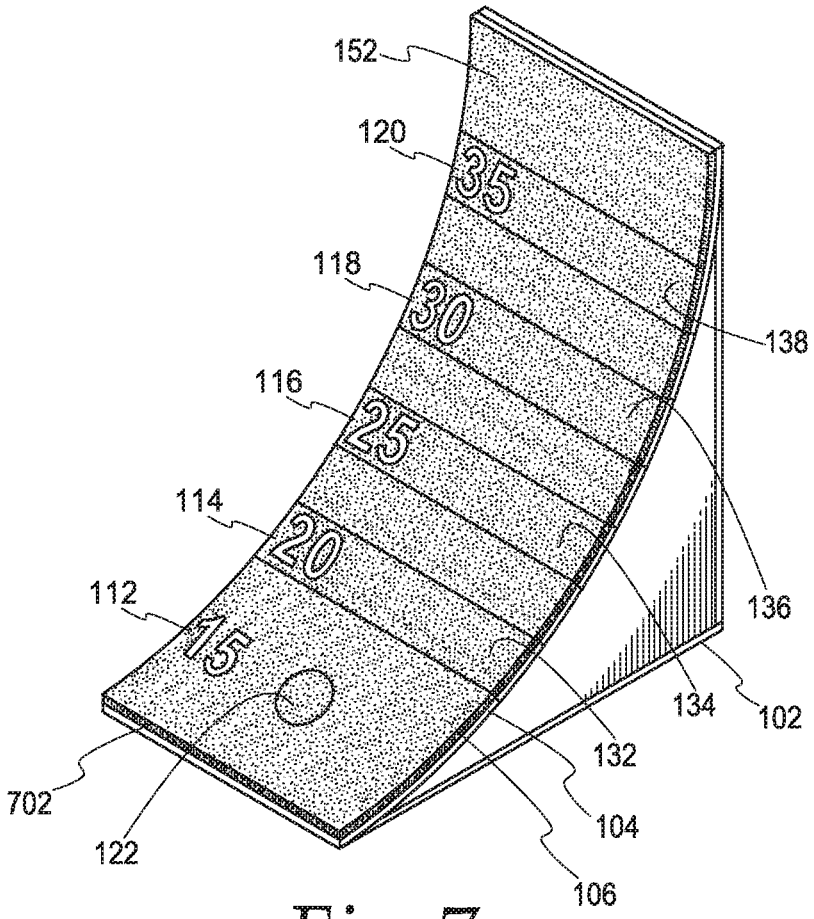
FIG. 7 is a perspective view of a new golf putting device with a ramp surface in accordance with this disclosure.
Figure 8:
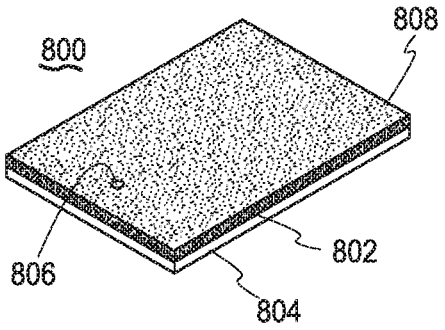
FIG. 8 is a perspective view of a golf putting device extension in accordance with this disclosure.

In one embodiment, a front end portion 142 of the golf putting device 100 is a flat portion. The flat front end portion 142 smoothly merges with the ramp surface 152. An alternate embodiment of the golf putting device 100, as shown in FIG. 7 and generally indicated at 700, does not incorporate the flat front end portion 142. In such a case, a flat extension 800 shown in FIG. 8 can be used with the putting device 700. To do so, a golfer places the extension 800 such that its front end 808 mates with the front end 702 of the putting device 700. The extension 800 includes a frame 804, a turf layer 802 attached to the frame 804, and also includes a distance reference indicia 806. In one implementation, the extension is six feet long while the length of the base of the frame 102 is about three fee and seven inches.

Figure 9:
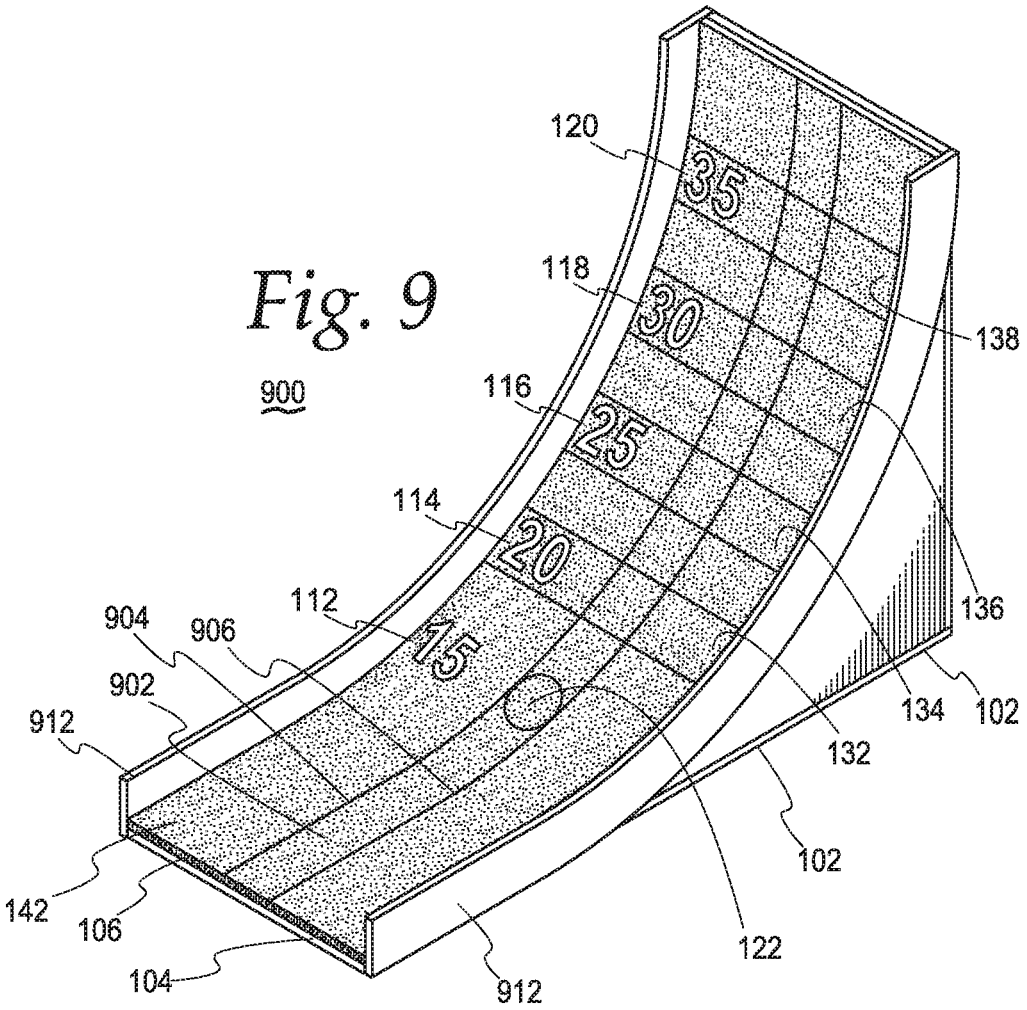
FIG. 9 is a perspective view of a new golf putting device with a ramp surface in accordance with this disclosure.

Referring to FIG. 9, a new golf putting device is shown and generally indicated at 900. The putting device 900 includes a putting hole zone indicia 902. The putting hole zone indicia 902 has a width of 4.25 inches, and intersects with each of the sliding distance bars 132-138. In one implementation, the putting hole zone indicia 902 is painted or labeled in white color. Alternatively, the putting hole zone indicia 902 is indicated by two lines (such as lines in white color) 904 and 906. It should be noted that the golf putting device 700 can also incorporate the putting hole zone indicia 902. The new golf putting device 900 also includes a rail 912 on each side of the ramp 152 to avoid golf balls falling off the device 900 in sideways.

When a golfer intends to practice putting for a particular distance, for example, of thirty (30) feet, the golfer removes sliding distance bar 136 from the new golfing putting device 100, and keeps the other sliding distance bars properly installed on the golf putting device 100. The golfer then places a golf ball at the spot 162 (or 806), and hits the ball with a putter. The ball moves forward and climbs up the ramp 152. If the hitting is too weak, the ball does not reach the opening 404, and comes down and back. If the hitting on the ball is too strong, the ball moves over opening 404, or bounces back from the upper edge of the opening 404. When the ball falls through the opening 404, it falls into the retriever 402 and rolls toward the read side 504 by gravity. When the ball goes into the opening 404, the ball would have reached a golf putting hole that is 30 feet away on a flat surface. The flat surface is the same golf turf as the ramp surface 152.

However, since the ramp surface 152 is an upward concave surface, the ball has to overcome gravity and climbs up to reach the opening 404. According, when the ball reaches the opening 404, the horizontal distance it travels is much shorter than 30 feet. This further illustrated by reference to FIG. 10.

Figure 10:
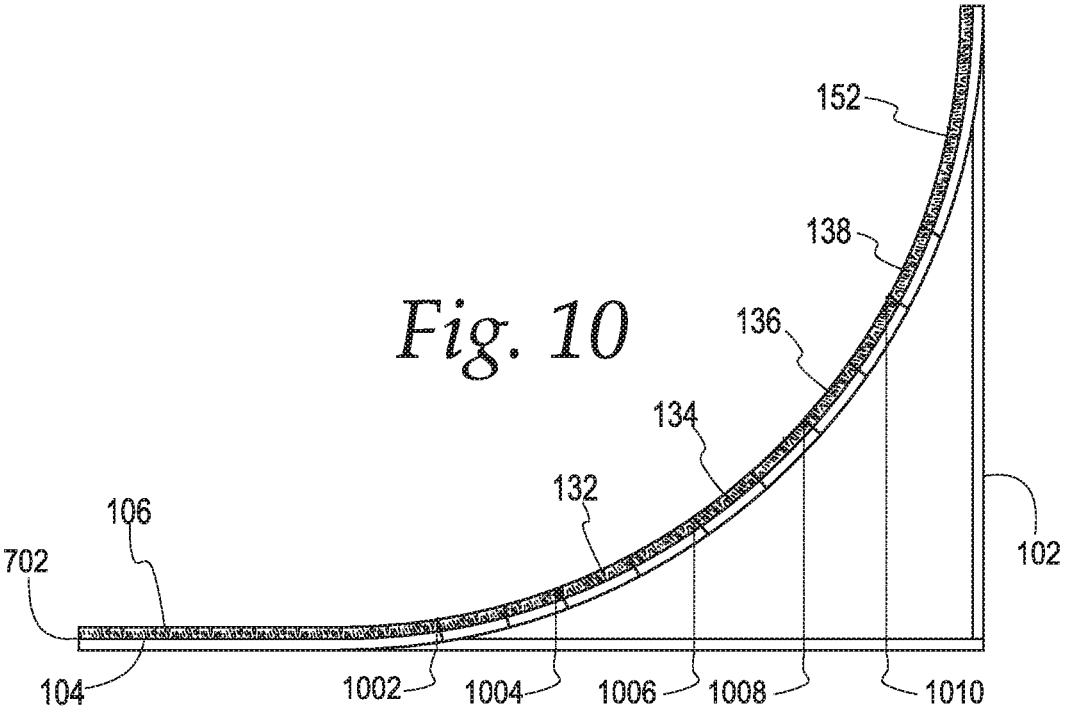
FIG. 10 is a right side view of a new golf putting device with a ramp surface in accordance with this disclosure.

Referring now to FIG. 10, a right side view of the golf putting device 100 is shown. 1002, 1004, 1006, 1008 and 1010 indicate the respective locations of the lower edges of the hole 406 and the sliding distance bars 132-138 when projected straight downward on to the horizontal bottom surface of the device 100. The respective shortest distance from the front edge 702 to 1002-1010 are referred to herein as the horizontal distances of the golf putting hole 406 and the sliding distance bars 132-138. In the illustrative embodiment, the abovementioned horizontal distances are 3 feet and 1.25 inches, 2 feet and 4 inches, 2 feet and 10.5 inches, 3 feet and 3 inches, and 3 feet and 10 inches.

Due to the much shorter horizontal distance caused by gravity, the golf putting device 100 is much shorter in length. In the illustrative embodiment, the biggest distance indicia is the indicia 120 that indicates a distance of 35 feet. In such a case, the golf putting device 100 allows a golfer to practice putting of 35 feet long while the device 100 is about 3 feet and 10 inches long. In other words, the golf putting device 100 of less than 4 feet long allows the golfer to practice golf putting of 35 feet long. Therefore, the golf putting device 100 significantly reduces the length requirement of a golf putting green.

Since the length of the opening 404 is significantly more than the diameter of a golf putting hole (i.e., 4.25 inches), the ball falls through the opening 404 as long as the hitting on it is proper and would have caused it to travel approximately 30 feet on flat turf surface. In other words, to achieve the goal of putting the ball for 30 feet long, the golfer is not required to send the ball into a hole of 4.25 inches in diameter. The area of the hole is much smaller than the area of the opening 404. Accordingly, the golf putting device 100 (700 and 900 as well) significantly improves golf putting practice efficiency when the goal is to only improve distance accuracy.

When the golfer intends to improve both her/his distance accuracy and angle accuracy, the golfer can utilize the putting hole zone indicia 902. When the ball is hit at a proper angle, it travels along the putting hole zone indicia 902. The putting hole zone indicia 902 indicates to the golfer whether her/his hitting angle on the ball is accurate. When both the distance accuracy and the angle accuracy are present, the ball travels along the putting hole zone indicia 902 and falls into the opening 404 through the intersection region between the putting hole zone indicia 902 and sliding distance bar 136.

The golf putting hole 406 allows the golfer to practice putting with a circular hole. To do so, the golfer removes the golf putting hole plug 122 to expose the golf putting hole 406 for putting practice.

The ramp layer 104, the frame 102 and the retriever 402 are made of, for example, wood, plastic, metal or synthetic materials. They can be integrally formed by, for example, molding. They can also be mounted together by, for example, welding or screws. The turf 106, 204 and 304 are attached to the layer 104, 202 and 302 respectively by, for example, glue.

Figure 11:
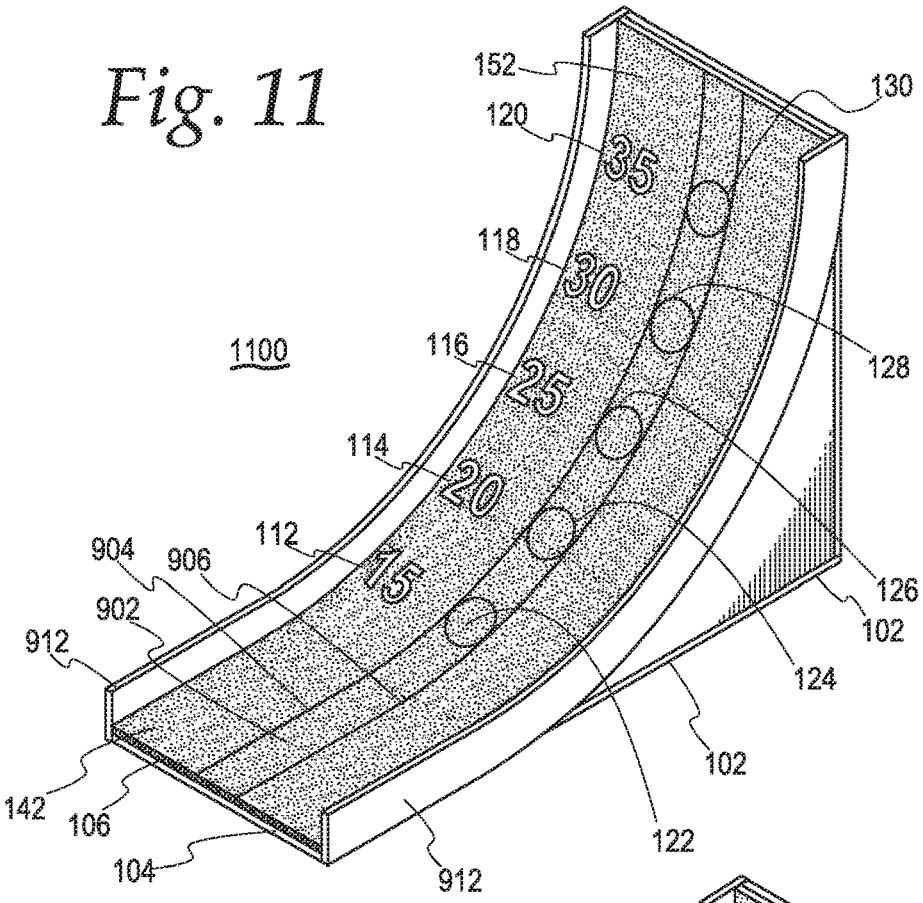
FIG. 11 is a front perspective view of a new golf putting device with a ramp surface in accordance with this disclosure.

Referring now to FIG. 11, a front perspective view of a putting device is shown and generally indicated at 1100. The new putting device 1100 is a different implementation from the new putting device 900. The new putting device 1100 does not incorporate any of the sliding distance bars 132-138. Instead, the new putting device 1100 incorporates additional golf putting hole plugs 124, 126, 128 and 130. Same as the golf putting hole plug 122, each of the golf putting hole plugs 124-130 includes a cylindrical body portion 202 and a plug turf layer 204 attached to the cylindrical body portion 202. The new putting device 1100 thus incorporates a set of golf putting holes, including the hole 406, for receiving the golf putting hole plugs 122-130 respectively. Each of the set of golf putting holes runs through the golf turf layer. The set of golf putting holes are aligned and positioned in the middle of the ramp surface.

With the body portion 202 being cylindrical, the hole 406 incorporates a bottom to prevent the plug 122 from falling through the hole 406. Alternatively, both the body portion 202 and the hole 406 are constructed to taper downward to prevent the body portion to fall through the hole 406.

In one particular embodiment, the diameter of each of the set of golf putting holes is approximately 3.5 inches. Accordingly, the diameter of the cylindrical body 202 and the golf turf layer 204 is approximately 3.5 inches, Each of the set of golf putting holes communicates with the golf ball retriever 402. Therefore, when a golf ball falls through a golf putting hole, it lands inside the golf ball retriever 402.

The set of golf putting hole plugs 122-130 corresponds to the set of distance indicia 112-120. For example, the distance indicia 112 indicates the putting distance of the golf putting hole 406. When a user intends to practice putting of a particular distance, such as 30 feet, she/he has the golf putting hole plugs 122, 124, 126 and 130 disposed within the corresponding golf putting holes such that their plug turf layers 204 form parts of the smooth ramp surface 152. In addition, she/he removes the golf putting hole plug 128 and exposed the corresponding putting hole.

Figure 12:
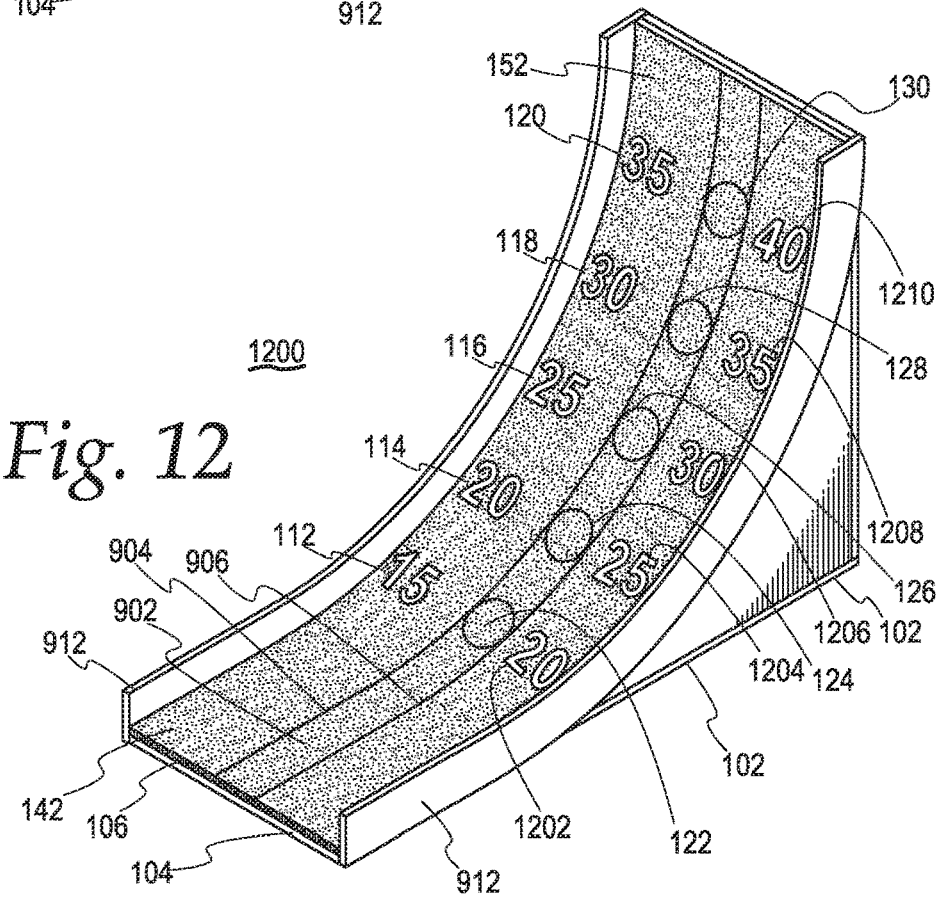
FIG. 12 is a front perspective view of a new golf putting device with a ramp surface in accordance with this disclosure.

Referring to FIG. 12, a front perspective view of a putting device is shown and generally indicated at 1200. The new putting device 1200 is a further embodiment of the putting device 1100. In particular, the new putting device 1200 incorporates an additional set of distance indicia 1202, 1204, 1206, 1208 and 1210 corresponding the same set of golf putting hole plugs 122-130. When the front end portion 142, with or without the flat extension 800, is longer, the distance indicia 1202 indicates a longer distance than that indicated by the distance indicia 112. For example, when the front end portion 142, with or without the flat extension 800, is properly sized, the distance indicia 1202 indicates 20 feet while the distance indicia 112 indicates 15 feet.

Figure 13:
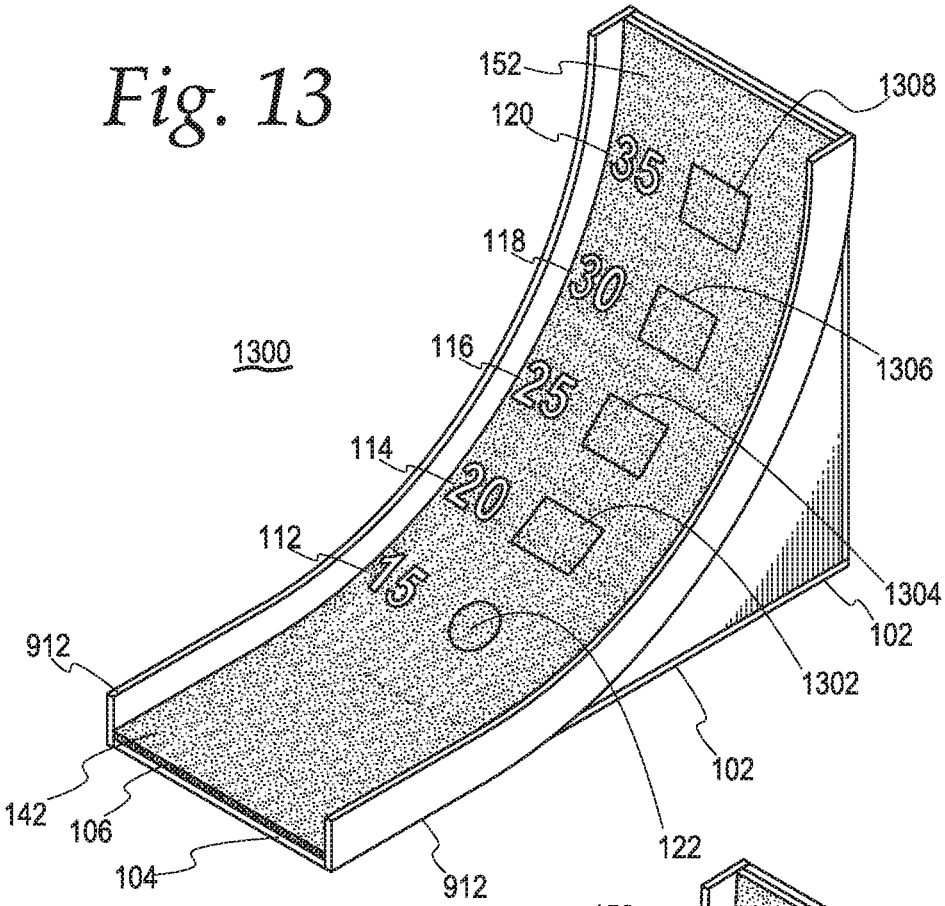
FIG. 13 is a front perspective view of a new golf putting device with a ramp surface in accordance with this disclosure.

Referring to FIG. 13, a front perspective view of a putting device is shown and generally indicated at 1300. The new putting device 1300 does not incorporate any of the sliding distance bars 132-138, or the golf putting hole plugs 124-130 and corresponding golf putting holes. Instead, the new putting device 1300 incorporates additional golf putting receptacle plugs 1302, 1304, 1306 and 1308 and corresponding golf putting receptacles. Same as the sliding distance bar 132, each of the golf putting receptacle plugs 1302-1308 includes a golf putting receptacle plug frame 304 and a golf putting receptacle plugs turf layer 302 attached to the frame 304. In one implementation, the golf putting receptacle plugs 1302-1308 are rectangular in shape with a dimension of four and a quarter inches in length and two inches in width.

Figure 14:
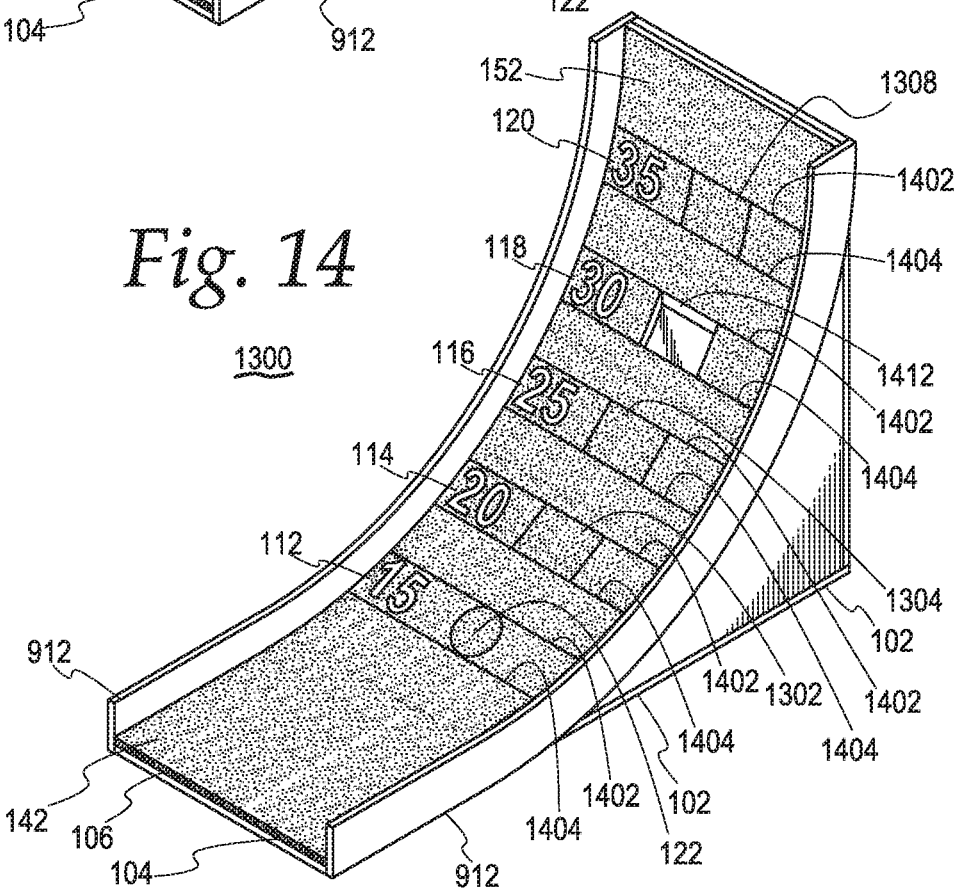
FIG. 14 is a front perspective view of a new golf putting device with a ramp surface in accordance with this disclosure.

Turning to FIG. 14, a front perspective view of the new putting device 1300 is shown with the golf putting receptacle plug 1306 removed. The corresponding golf putting receptacle 1412 is exposed. When the golf putting receptacle 1412 is exposed, a user can practice golf putting by trying to hit a golf ball such that it lands into the putting receptacle 1412. The putting receptacle 1412 communicates with the golf ball retriever 402. The golf putting receptacles, such as the golf putting receptacle 1412, each includes a stopper to prevent the golf putting receptacle plugs 1302-1308 from falling through the receptacles. For instance, the golf putting receptacle 1412 incorporates bars on two or four sides of it at the depth that is same as the height of the golf putting receptacle plug 1306. The bars stop the golf putting receptacle plug 1306 from falling through the golf putting receptacle 1412. In one implementation, the golf putting receptacle plugs 1302-1308 each include a puller attached thereto. The pullers can be made from, for example, soft fabric materials, and allow a user to pull the plugs out of and away from the corresponding receptacles.

In a further implementation, the golf putting device 1300 includes two target zone indicia 1402 and 1404 for the distance indicia 112-120. The target zone indicia 1402-1404 provide beneficial feedback to users. Taking the target zone indicia 1402-1404 for the distance indicia 118 as an example, when a golf ball does not land in the receptacle 1412, but reaches the target zone marked by the target zone indicia 1402-1404 before it comes down the ramp 152, the user would appreciate that her/his putting is of proper hitting force while the hitting angle needs to be improved. It should be noted that the golf putting device 1300 can also incorporate the zone indicia 902 as shown in FIG. 9.

Without deviating from the present teachings, the golf putting receptacles 1412 can be constructed in square shapes or oval shapes. As used herein, a square is regarded as a rectangle as well. Furthermore, the golf putting receptacles 1412 can be constructed in different dimensions. The illustrative dimension of approximately four and a quarter inches in length and two inches in width (4.25×2) provides additional benefits. The diameter of a golf ball is about 1.68 inches. The width of 2 inches allows golf balls to fall through the receptacles 1412. However, compared to the diameter of 4.25 inches of regular golf holes, the smaller width of 2 inches allows a user to improve putting accuracy. The smaller target demands higher accuracy. The two inch gap insures that a golf ball struck too hard will jump over the gap. The smaller receptacle does not provide positive feedback when the ball is not struck with proper force and/or angle. With the golf ball being slightly smaller than the receptacle 1412, only proper stroke can place the golf ball in the receptacle.

The golf putting devices 1100 and 1300 each can be operated with the extension 800, The extension 800 is also termed herein as a flat turf extension. The total length of the base of the frame 102 of the golf putting device and the extension 800 is nine feet and seven inches in one implementation.

Obviously, many additional modifications and variations of the present disclosure are possible in light of the above teachings. Thus, it is to be understood that, within the scope of the appended claims, the disclosure may be practiced otherwise than is specifically described above. For example, the new putting device 100 is constructed as a stationary putting device. As another example, more than four or less than four sliding distance bars can be incorporated in a particular embodiment. At still another example, the golf putting device 100 includes the extension 800.

The foregoing description of the disclosure has been presented for purposes of illustration and description, and is not intended to be exhaustive or to limit the disclosure to the precise form disclosed. The description was selected to best explain the principles of the present teachings and practical application of these principles to enable others skilled in the art to best utilize the disclosure in various embodiments and various modifications as are suited to the particular use contemplated. It should be recognized that the words "a" or "an" are intended to include both the singular and the plural, Conversely, any reference to plural elements shall, where appropriate, include the singular.

It is intended that the scope of the disclosure not be limited by the specification, but be defined by the claims set forth below. In addition, although narrow claims may be presented below, it should be recognized that the scope of this invention is much broader than presented by the claim(s). It is intended that broader claims will be submitted in one or more applications that claim the benefit of priority from this application. Insofar as the description above and the accompanying drawings disclose additional subject matter that is not within the scope of the claim or claims below, the additional inventions are not dedicated to the public and the right to file one or more applications to claim such additional inventions is reserved.

What is claimed is:

1. A golf putting device comprising:

1) a frame;
2) a ramp layer mounted to said frame;
3) a golf turf layer attached to said ramp layer and forming a ramp surface, said ramp surface being concave in shape, said golf turf layer made of synthetic golf turf;
4) a first set of distance indicia on said golf putting device, said first set of distance indicia indicating a set of different distances, wherein distances within said set of different distances are increasing;
5) a set of golf putting receptacles in rectangular shapes corresponding to a set of horizontal distances respectively, corresponding to said first set of distance indicia respectively and running through said golf turf layer, wherein
   i) said set of golf putting receptacles consists of golf putting receptacles that are aligned generally in the middle of a ramp width of said ramp surface and extend upward on said ramp surface in one row;
   ii) each distance within said set of different distances is longer than a corresponding horizontal distance within said set of horizontal distance; and
   iii) each distance within said set of different distances indicates a distance that a golf ball would have traveled on a flat golf turf surface when said golf ball travels on said ramp surface and falls into a corresponding golf putting receptacle within said set of golf putting receptacles;
6) a set of golf putting receptacle plugs adapted to be received by and removed from said set of golf putting receptacles respectively, each of said set of golf putting receptacle plugs including a body portion and a receptacle turf layer attached to said body portion, said receptacle turf layer made of synthetic golf turf and adapted to form a part of said ramp surface;
7) a set of rails on sides of said ramp surface;
8) a set of target zone indicia corresponding to said set of golf putting receptacles respectively; and
9) a golf ball retriever communicating with said set of golf putting receptacles.

2. The golf putting device of claim 1 further comprising a flat front end portion.

3. The golf putting device of claim 1 further comprising a flat extension adapted to smoothly mate with a front end of said golf putting device.

4. The golf putting device of claim 1 wherein said first set of distance indicia is on said golf turf layer.

5. A golf putting device comprising:

1) a frame;
2) a ramp layer mounted to said frame;
3) a golf turf layer attached to said ramp layer and forming a ramp surface, said ramp surface being concave in shape, said golf turf layer made of synthetic golf turf;
4) a first set of distance indicia on said golf putting device, said first set of distance indicia indicating a set of different distances, wherein distances within said set of different distances are increasing;
5) a set of golf putting receptacles in rectangular shapes corresponding to a set of horizontal distances respectively, corresponding to said first set of distance indicia respectively and running through said golf turf layer, wherein
   i) said set of golf putting receptacles consists of golf putting receptacles that are aligned generally in the middle of a ramp width of said ramp surface and extend upward on said ramp surface in one row;
   ii) each distance within said set of different distances is longer than a corresponding horizontal distance within said set of hod zonal distance; and
   iii) each distance within said set of different distances indicates a distance that a golf ball would have traveled on a flat golf turf surface when said golf ball travels on said ramp surface and falls into a corresponding golf putting receptacle within said set of golf putting receptacles; and
6) a set of golf putting receptacle plugs adapted to be received by and removed from said set of golf putting receptacles respectively, each of said set of golf putting receptacle plugs including a body portion and a receptacle turf layer attached to said body portion, said receptacle turf layer made of synthetic golf turf and adapted to form a part of said ramp surface.

6. The golf putting device of claim 5 wherein each golf putting receptacle within said set of golf putting receptacles has a width of approximately two inches.

7. The golf putting device of claim 6 wherein each golf putting receptacle within said set of golf putting receptacles has a length of approximately four and a quarter inches.

8. The golf putting device of claim 5 further comprising a flat frontend portion.

9. The golf putting device of claim 5 further comprising a flat extension adapted to smoothly mate with a front end of said golf putting device.

10. The golf putting device of claim 5 further comprising a golf ball retriever communicating with said set of golf putting receptacles.

11. The golf putting device of claim 5 further comprising a set of target zone indicia corresponding to said set of golf putting receptacles respectively.

12. The golf putting device of claim 5 further comprising a set of rails on sides of said ramp surface.

13. The golf putting device of claim 5 wherein said first set of distance indicia is on said golf turf layer.

* * * * *